US009446299B2

(12) United States Patent
Hewitt et al.

(10) Patent No.: US 9,446,299 B2
(45) Date of Patent: Sep. 20, 2016

(54) BREATHABLE AND ADJUSTABLE FIELDING GLOVE

(71) Applicant: Nike, Inc., Beaverton, OR (US)

(72) Inventors: Jeremy J. Hewitt, Beaverton, OR (US); Matthew Hudson, Portland, OR (US); Mark McNamee, Portland, OR (US); Mark A. Wong, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 298 days.

(21) Appl. No.: 14/174,016

(22) Filed: Feb. 6, 2014

(65) Prior Publication Data

US 2014/0259257 A1 Sep. 18, 2014

Related U.S. Application Data

(60) Provisional application No. 61/789,601, filed on Mar. 15, 2013.

(51) Int. Cl.
*A63B 71/14* (2006.01)
*A41D 19/00* (2006.01)

(52) U.S. Cl.
CPC ..... *A63B 71/143* (2013.01); *A63B 2102/18* (2015.10)

(58) Field of Classification Search
CPC ..... A63B 71/143; A41D 19/0048; A43C 11/008; A43C 3/00; A43C 7/00
USPC ..... 2/19
See application file for complete search history.

(56) References Cited

U.S. PATENT DOCUMENTS

| | | | | |
|---|---|---|---|---|
| 2,629,096 | A * | 2/1953 | Latina | A63B 71/143 2/19 |
| 2,988,744 | A | 6/1961 | Stobbe | |
| 4,720,875 | A | 1/1988 | Latina et al. | |
| 4,847,915 | A | 7/1989 | Keene | |
| 4,853,975 | A | 8/1989 | Clevenhagen | |
| 5,367,712 | A | 11/1994 | Smith et al. | |
| 5,379,459 | A * | 1/1995 | Williams, Jr. | A63B 71/143 2/161.1 |
| 5,379,460 | A * | 1/1995 | Aoki | A63B 71/143 2/161.1 |
| 5,398,342 | A * | 3/1995 | Kinnee | A63B 71/143 2/161.1 |
| 6,249,915 | B1 | 6/2001 | Hang | |
| 6,353,931 | B1 | 3/2002 | Gilligan et al. | |
| 6,571,394 | B1 * | 6/2003 | Hackett | A63B 71/143 2/19 |
| 7,278,170 | B2 * | 10/2007 | Anderson | A63B 71/143 2/159 |
| 2008/0060105 | A1 | 3/2008 | Lin | |
| 2012/0000091 | A1 * | 1/2012 | Cotterman | A43C 3/00 36/50.1 |
| 2012/0316485 | A1 | 12/2012 | Fryda et al. | |
| 2012/0324623 | A1 | 12/2012 | Cabauy et al. | |

* cited by examiner

*Primary Examiner* — Bobby Muromoto, Jr.
(74) *Attorney, Agent, or Firm* — Shook, Hardy & Bacon, LLP

(57) ABSTRACT

A baseball fielding glove capable of receiving a human hand is provided. The glove comprises an exterior glove shell and an interior glove liner. The glove comprises a strut in place of traditional webbing. Further, the glove's exterior shell corresponding to the palm of a wearer comprises a plurality of perforations for enhancing ventilation. The fielding glove disclosed is readily adjustable eliminating the need for a breaking-in process. A tensioning cord extending between the strut and finger/thumb stalls of the glove provide an enhanced degree of adjustable characteristics to the glove.

16 Claims, 10 Drawing Sheets

BREATHABLE AND ADJUSTABLE FIELDING GLOVE

CROSS-REFERENCE TO RELATED APPLICATIONS

This application claims the benefit of U.S. Provisional Application No. 61/789,601, filed on Mar. 15, 2013, entitled "BREATHABLE AND ADJUSTABLE BASEBALL FIELDING GLOVE," the entirety of which is hereby incorporated by reference.

STATEMENT REGARDING FEDERALLY SPONSORED RESEARCH OR DEVELOPMENT

Not applicable.

TECHNICAL FIELD

The present invention relates to athletic gloves. More particularly, the present invention relates to baseball fielding gloves.

BACKGROUND

Athletic gloves of various types are widely used in sports to improve performance. In sports such as baseball and softball, players typically wear a glove on the non-throwing hand for catching the ball. Because baseball gloves are typically made of materials such as leather with layers of padding to dissipate the force exerted on the hand by a caught ball, the gloves tend to become hot and uncomfortable after some time, particularly in warm and hot weather. The discomfort may have an impact on the performance of the athlete.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Aspects of the present invention relate to a fielding glove (or "glove"), such as a baseball fielding glove, that uses a tensioning cord to provide adjustability. The tensioning cord may interconnect the finger stall portions, the thumb stall, and the web, permitting the wearer to adjust the shape and/or fit of the glove by adjusting the tension applied through the tensioning cord. The cabling system can use a single tensioning cord to connect the finger stall portion, the thumb stall, and the web. In one aspect, the tensioning cord is a woven or knit cord rather than the traditional leather cords. In one aspect, one or more tensioning cords are double threaded through the glove.

Breathability and flexibility can be provided by including perforations in the exterior of the glove. In one aspect, the perforations are included in the front side of the glove exterior. The front side of the glove, or palm side, is the side that a player uses to catch the baseball. The perforations help reduce creasing and increase the suppleness or flexibility of the glove exterior. The increased suppleness can reduce the time it takes for a player to break in the glove.

Additional objects, advantages, and novel features of the invention will be set forth in part in the description that follows, and in part will become apparent to those skilled in the art upon examination of the following, or may be learned by practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

Figure 1:
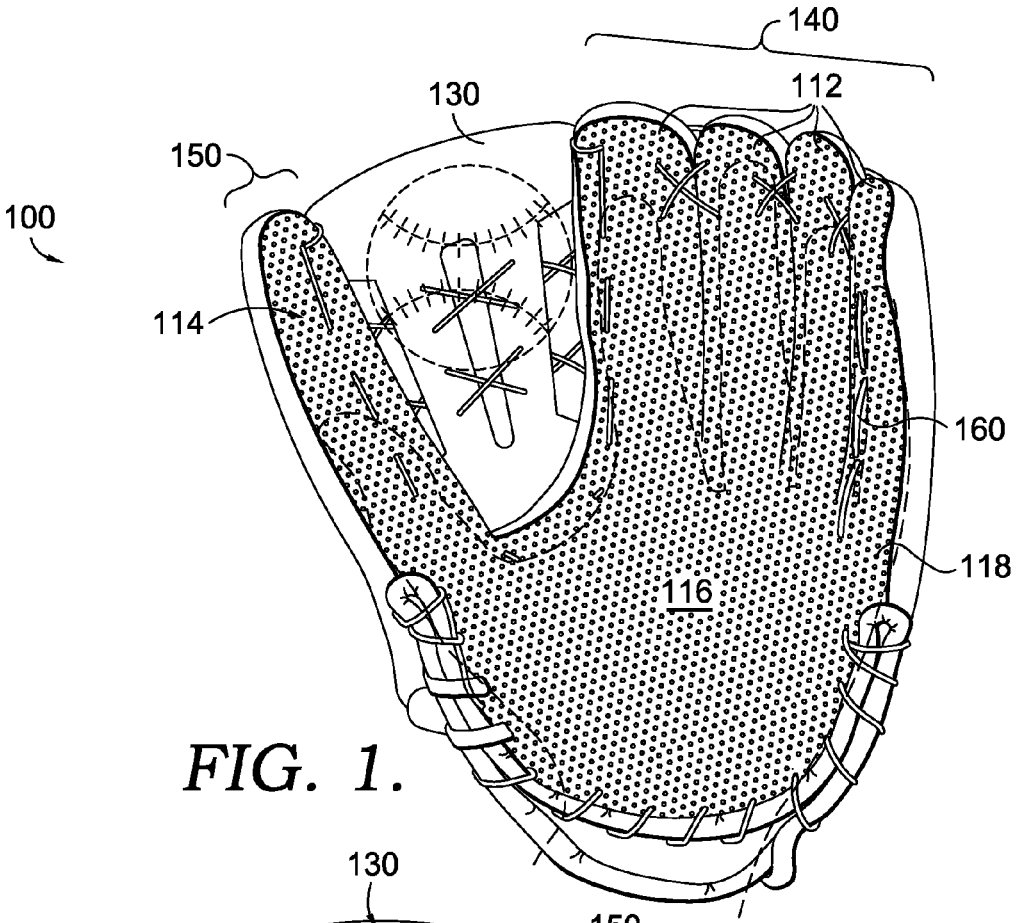
FIG. 1 is a palm-side view of a glove in accordance with the present invention as worn by a user when catching a ball, according to an aspect of the invention.

In conventional gloves used in baseball and softball, glove shaping is provided through the breaking-in process. The materials used in the fabrication of these conventional gloves tend to be thick and heavy to achieve their goal of providing a glove with enough padding to prevent injury to a wearer's hand from the impact caused by catching a flying ball.

Aspects of the present invention provide a fielding glove that is suitable to be used in sports such as baseball and softball, which is light, breathable, and adjustable for an improved breaking-in process. The glove can have tensioning cords connecting the finger stalls, the thumb stalls, and the ball catching strut (alternatively semi-rigid strut or strut) so that the shape of the glove may be adjusted by adjusting the tension in the tensioning cord or cords. The strut replaces the webbing traditionally found in a baseball glove.

In an aspect of the invention, the glove has an exterior glove shell and an interior glove lining with padding in between, particularly for the palm-side. In some examples, the interior glove liner may be made of leather, synthetic leather, fabric, or any other suitable material that is thinner than the exterior glove shell. The interior glove liner may be formed from multiple pieces of material and may comprise a substantial portion or the entire interior surface of the glove. The interior glove liner may be made to closely fit a wearer's hand, while the exterior glove shell is typically made to extend beyond the wearer's hand. The close fit of the interior glove liner to the wearer's hand may provide the wearer with enhanced control over the glove. The glove liner may be connected to the exterior glove shell at least at the rim of the opening for receiving the wearer's hand.

Breathability and flexibility can be provided by including perforations in the exterior glove shell. In one aspect, the perforations are included in the front side of the glove exterior. The front side of the glove, or palm side, is the side that a player uses to catch the baseball. The perforations help reduce creasing and increase the suppleness or flexibility of the glove exterior. The increased suppleness can reduce the time it takes for a player to break in the glove.

In an aspect, the glove may be a glove having finger stalls that are separate and distinct from each other, interconnected as they distally extend from a palm region only by at least one tensioning cord running through all finger stalls. In one aspect, two tension cords are double threaded through all the finger stalls. In another aspect, a single cord is double threaded through all the finder stalls. The group of finger stalls may be described the finger stall portion of the glove. Alternatively, the glove may be closer to a mitt, such as may be used by catchers and/or first basemen, for which finger stalls are not clearly distinct from each other when the palm-side of the exterior glove shell is primarily viewed. The four finger stalls of the palm-side portion of the exterior glove shell of a mitt can be connected together to form a continuous piece. Separate finger sheaths may be provide in the interior of the glove when the stalls are separate or when combined into a continuous piece. A finger sheath can substantially conform to the size and shape of a finger or thumb.

The glove may additionally have one or more cushioning layers to provide support and rigidity to the glove. The cushioning layers may be made of felt, leather, synthetic layer, a foam material, etc. The cushioning layers may or may not have a plurality of perforations for allowing ventilation of the glove. The perforation in the foam may be created by removing a small section from a solid material used to create the cushioning. Accordingly, the perforations can reduce the overall weight of the glove. The thickness of the cushioning layers may be adjusted according to the rigidity and cushioning ability of the material used. The cushioning layers in the glove may be provided to the areas of the glove corresponding to a palm of the wearer, particularly at the heel of the glove.

Glove 100 is designed to receive a left hand. Gloves designed to receive a right hand are also envisioned and are within the scope of the present invention. For simplicity, only a glove designed to receive a left hand is shown in the drawings.

FIG. 1 illustrates a palm-side view of a glove 100 in accordance with an aspect of the present invention. As seen in FIG. 1, the exterior-facing palm portion of the glove 100 may comprise material with a plurality of perforations 118. The perforated material may be leather, suede, synthetic leather, or any other suitable pliable sheet material for the manufacturing of gloves. These materials may be used as they are, or may also be treated with materials to improve the inherent properties of the material such as, for example, water resistance and pliability. In other aspects of the present invention, the palm-facing portion of the glove 100 may be comprised of two or more perforated materials that are, for example, the same material and color, the same material and different color, different material and the same color, or different material and different color. In an aspect, it can be desirable to use at least two different types of materials for the exterior-facing palm portion for, for example, providing a thicker portion at the palm for extra cushioning. The perforations help reduce creasing and increase the suppleness or flexibility of the glove exterior. The increased suppleness can reduce the time it takes for a player to break in the glove.

The plurality of perforations 118 may provide the glove with ventilation, thereby improving the comfort level of the glove, particularly when the glove needs to be worn for an extended period of time. The plurality of perforations 118 may be of any shape or size suitable for the athletic glove. For example, in FIG. 1, the plurality of perforations 118 are shown to be circular in shape, however, the plurality of perforations 118 may be square, oval, rectangular, etc. Additionally, the plurality of perforations 118 may have a diameter or width ranging from 0.1 to 5.0 mm on each side, depending on the shape of the plurality of perforations 118. Further, the plurality of perforations 118 may be uniformly distributed throughout the exterior-facing palm portion, or may be distributed to have varying density at different regions of the exterior-facing palm portion, or may be distributed in gradients employing perforations of different sizes, the plurality of perforations 118 may be made to form particular designs on the palm portion, for example, by using perforations of different shapes and/or sizes, etc.

The exterior-facing palm portion, if made up of one sheet of material, may be shaped accordingly to define four finger stalls 112 continuously with a palm region 116. Alternatively, the palm region 116 and at least one finger stall 112 may be made from a continuous piece of material, while having the other finger stalls attached to the palm region 116, or alternatively, all the finger stalls 112 may be attached to the palm region 116 by any suitable method such as stitching, gluing, adhesively bonding, etc. Further, thumb stall 114 may also be made continuously with the palm region 116, or the thumb stall 114 may be attached to the palm region by any suitable method as described above. The finger stalls 112 and the thumb stalls 114 could potentially be made of the same material as the palm region 116, or materials differing from the palm region 116. In other words, the exterior-facing palm portion could potentially be zoned as to enhance the ventilation in the glove 100.

In FIG. 1, the traditional glove "web" is replaced by at least one strut 130, which provides a stable and sturdy ball catching region for the glove 100. The at least one strut 130 is not permanently attached to any part of the glove, instead, the at least one strut 130 is kept in place by at least one tensioning cord 160. By virtue of the strut not being permanently attached to the glove 100, the ball-catching pocket formed by the thumb stall 150, the strut 130, and the finger stall portion 140 corresponding to an index finger of a wearer, the ball-catching pocket may be adjusted by varying the tension on the at least one tensioning cord 160. Thereby, the ball-catching pocket may be flared, or tightened, according to the wearer's preferences. The strut 130 may comprise a rigid material, a semi-rigid material, or a flexible material, depending on the desired properties of the glove. The strut 130 may be made from plastic, thermoplastic, leather, synthetic leather, or any other suitable material.

Further, the tensioning cords, may interconnect the finger stall portion 140, the thumb stall 150, and the at least one strut 130. Accordingly, the wearer, using the at least one tensioning cord 160, may adjust the overall shape and/or fit of the glove to achieve a desired shape and/or fit of the glove. While the figures provided herein depict a single tensioning cord at a given location, it is contemplated that two or more cords may be used in parallel configuration to achieve a desired result. For example, it is contemplated that a change in the diameter of the tensioning cord may be performed to adjust a tensile strength and/or an ease of tensioning. Similarly, it is contemplated that a number of tensioning cords used in parallel may (e.g., multiple cords passing through a common tunnel in a common path) be implemented to achieved variations in desired properties. Further, it is contemplated that different sizes and materials of tensioning cords may be used in different location and/or in different combinations to achieve a desired resulting property for the glove. Running a number of tensioning cords in parallel may be described as double threading.

Figure 2:
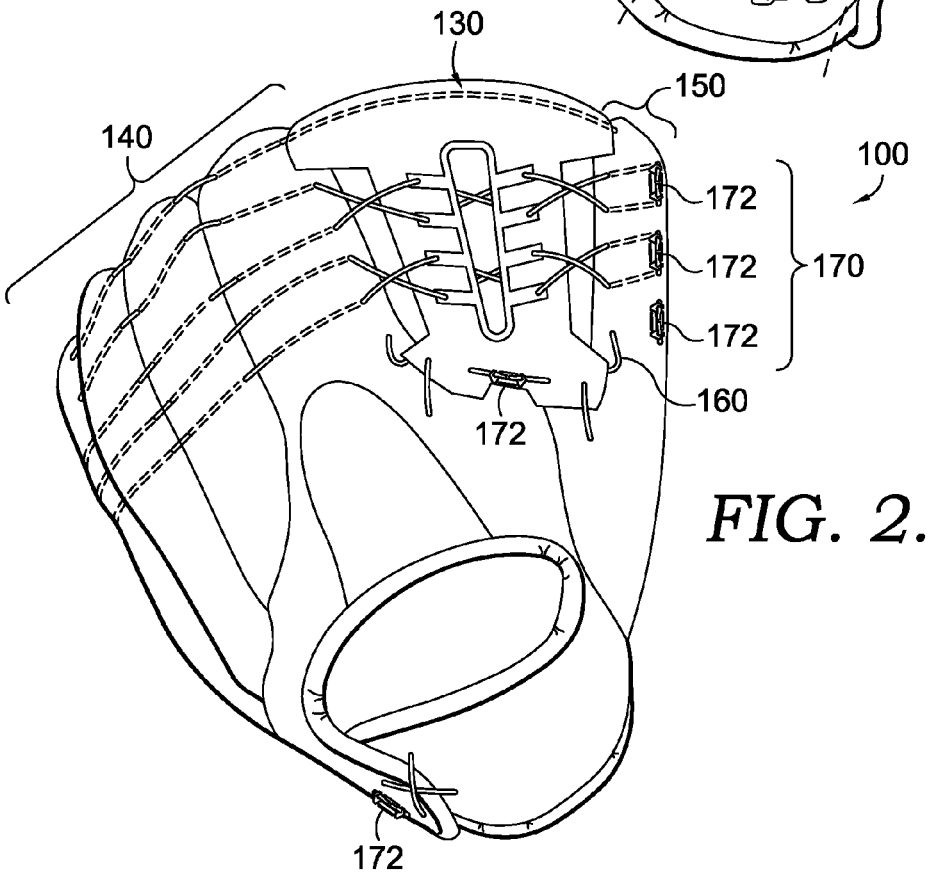
FIG. 2 is back-side view of the glove shown in FIG. 1, particularly showing how the tensioning cords interconnect the different finger stall portions and a strut of the glove, according to an aspect of the invention.

FIG. 2 is a back-side view of the glove 100 presented in FIG. 1. The exterior facing back portion of the glove 100 may be made of the same materials as the exterior-facing palm portion, or alternatively, a different material from that used for the palm portion may be used. Further, the exterior facing back portion may or may not have the plurality of perforations 118 such as are present in the palm portion of glove 100. The back portion of glove 100 may be made of a single piece of material, or may be formed by affixing at least two pieces of material together to form finger stalls and a thumb stall for joining with finger stalls 112 and thumb stall 114 respectively, to form finger stall portion 140 and thumb stall 150. Further, the back may comprise a back region to be joined with palm region 116 to form the glove 100.

Further, FIG. 2 also shows a clearer view of how the one or more tensioning cords 160 may be arranged within the glove 100 to provide the ability for adjusting the glove shape by adjusting the tension on the one or more tensioning cords 160 at tensioning points 170. In other words, the one or more tensioning cords 160 may be under a first tension before adjustment and under a second tension after adjustment. After a desired shape is achieved by adjusting the tensioning cords 160 at tensioning points 170, the glove 100 may be stabilized to the desired shape by providing at least one tensioning cleat 172 capable of preventing the one or more tensioning cords 160 from sliding or shifting when locked. The at least one tensioning cleat 172 may also provide a guide for the one or more tensioning cords 160 to slide through when unlocked so that when the glove 100 is being adjusted, the tensioning cords 160 are kept in place. The at least one tensioning cleat 172 may be a permanent fixture on the glove, or it may be detachably attached to the tensioning cord or the material forming the glove to retain the one or more tensioning cords. Also as shown in FIG. 2, the one or more tensioning cords 160 may continuously run through the strut 130 in addition to the finger stall portion 140 and thumb stall 150 so that the overall shape of the glove may be adjusted by adjusting the tension at key tensioning points 170 in the glove 100.

For example, in FIG. 2, glove 100 is shown to have three tensioning points 170 for the finger stall portion 140, the strut 130 and thumb stall 150. Additionally, a tensioning point 170 is shown for adjustment of just the strut 130, and a separate tensioning point is shown for adjustment of the wrist portion of the glove 100, each having their own tensioning cleat 172. However, the glove 100 shown in FIGS. 1 and 2 is only an example of a glove in accordance with an aspect of the present invention. Different arrangements and numbers of tensioning points are also possible in aspects of the invention.

For example, each tensioning point 170 may comprise its own discrete tensioning cord 160 with its own tensioning cleat 172. Alternatively, one tensioning cord 160 may run through two or more tensioning points 170, each tensioning point comprising its own tensioning cleat 172, or one tensioning cleat 172 may be used for keeping the tensioning cord 160 running through two or more tensioning points 170 in place. It is envisioned that if one tensioning cord 160 is used to run through two or more tensioning points 170 instead of two or more tensioning cords 160 at the different tensioning points 170 in glove 100, the one tensioning cord 160 will be longer than the two or more tensioning cords 160.

Figure 3:
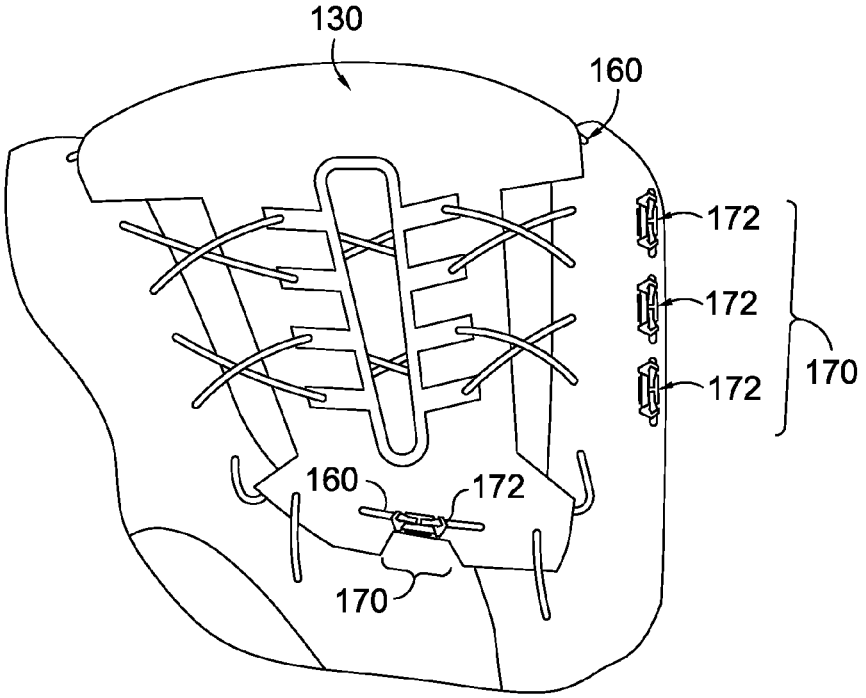
FIG. 3 is a close up view of the strut in a "loose" state, according to an aspect of the invention.
Figure 4:
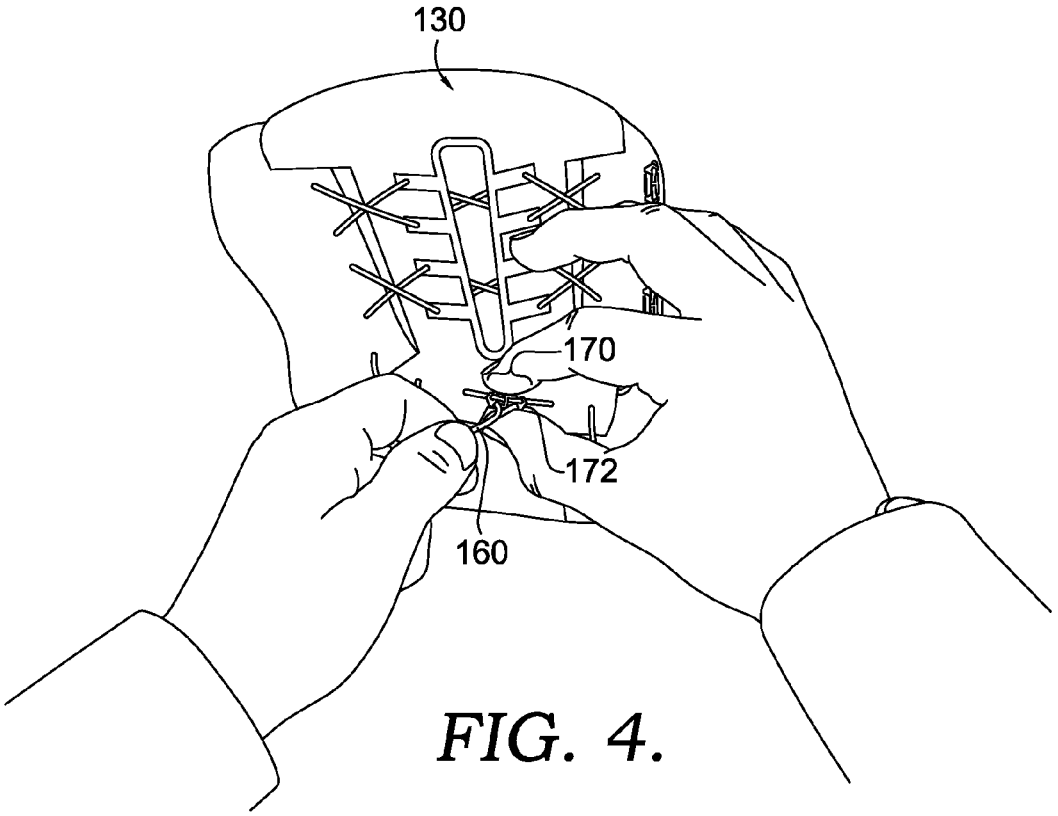
FIG. 4 is a close up view of the same strut of FIG. 3, showing how the tension on the glove can be adjusted to adjust the shape of the glove, according to an aspect of the invention.

FIGS. 3 and 4 are close-up views of the strut 130 of glove 100. FIG. 3 represents a before increased-tension adjustment view and FIG. 4 represents an after increased-tension adjustment view. As seen in FIG. 4, the overall structure is tightened to form a smaller ball-catching pocket compared to FIG. 3.

Figure 5:
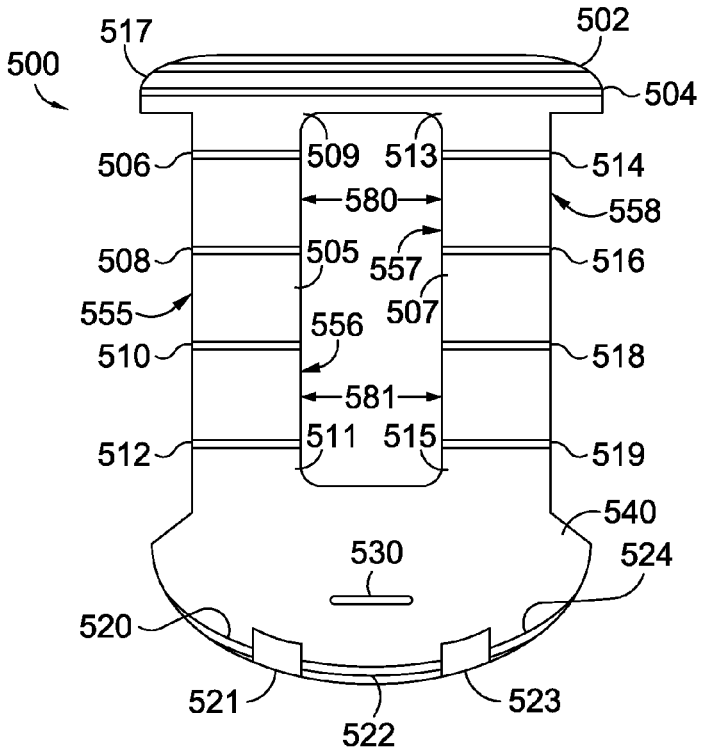
FIG. 5 is a diagram of a H-shaped strut, according to an aspect of the invention.

Turning now to FIG. 5, an H-shaped strut 500 is shown, in accordance with an aspect of the present invention. It is contemplated that the H-shape strut 500 provides increased playability for a fielding glove as a result of greater sightline for a user to perceive an incoming ball through the strut relative to a traditional web Like strut 130, strut 500 is adapted to replace webbing traditionally used in a baseball glove. The strut 500 is adapted to fit in the crotch between the thumb stall and index finger stall. The strut 500 comprises a thumb-side column 505 and a finger-side column 507. The thumb-side column 505 has a top end 509 and a bottom end 511. The finger-side column 507 has a top end 513 and a bottom end 515.

The top end 513 of the finger-side column 507 and the top end 509 of the thumb-side column join a top portion 517. The bottom end 515 of the finger-side column 507 and the bottom end 511 of the thumb-side column join a base 540. Because the two columns are approximately parallel, the distance 580 between the top end 509 and the top end 513 is approximately equal to the distance 581 between the bottom end 511 and the bottom end 515. The left lateral edge 555 of the thumb-side column 505 and the right lateral edge 556 of the thumb-side column 505 are substantially parallel to each other. Similarly, the left lateral edge 557 of the finger-side column 507 and the right lateral edge 558 of the finger-side column 507 are substantially parallel to each other.

Multiple tunnels run through the strut 500. The tunnels are sized to receive a tensioning cord that connects the strut 500 to the thumb stall and a finger stall. In one aspect, the cross-section area defined by the interior walls of the tunnel provides enough area for the tensioning cord to move relative to the tunnel wall during a tensioning. In other words, the cross-section area defined by the interior wall of the tunnels is slightly larger than the cross-sectional area of the tensioning cord. Tightening the tensioning cord can urge the thumb stall and finger stall closer together and cause the strut 500 to bow outward towards the back (e.g., dorsum) of the glove.

Tunnel 502 and tunnel 504 run through the top portion 517. Tunnel 502 and tunnel 504 run substantially perpendicular to columns 505 and 507. Tunnel 506, tunnel 508, tunnel 510, and tunnel 512 run through the thumb-side column 505 in an approximately perpendicular orientation. Tunnel 514, tunnel 516, tunnel 518, and tunnel 519 run through the finger-side column 507 in an approximately perpendicular orientation.

Tunnel 520, tunnel 522, and tunnel 524 run through base portion 540. Opening 521 and opening 523 provide access to a tensioning cord running through the tunnels 520, 522 and 524. In one aspect, a tensioning cord is tied in a knot and inserted into pocket 530. Pocket 530 may take the form of a tunnel with only one opening.

Figure 6:
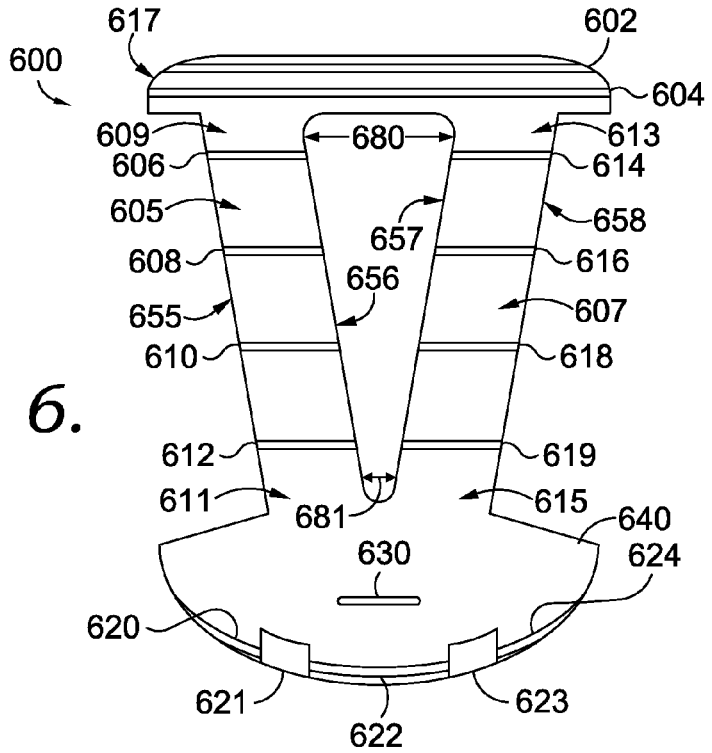
FIG. 6 is a diagram of a V-shaped strut, according to an aspect of the invention.

Turning now to FIG. 6, a V-shaped strut 600 is shown, in accordance with an aspect of the present invention. It is contemplated that the V-shape strut 600 provides increased playability for a fielding glove as a result of greater sightline for a user to perceive an incoming ball through the strut relative to a traditional web as well as increased flexibility of the glove because of the correlation between a crotch shape between thumb stall and index finger stall portions and the V-shape of the strut. Like strut 130, strut 600 is adapted to replace webbing traditionally used in a baseball glove. The strut 600 is adapted to fit in the crotch between the thumb stall and index finger stall. The strut 600 comprises a thumb-side column 605 and a finger-side column 607. The thumb-side column 605 has a top end 609 and a bottom end 611. The finger-side column 607 has a top end 613 and a bottom end 615.

The top end 613 of the finger-side column 607 and the top end 609 of the thumb-side column join a top portion 617. The bottom end 615 of the finger-side column 607 and the bottom end 611 of the thumb-side column join a base 640. Because the two columns form a V, the distance 680 between the top end 609 and the top end 613 is larger than the distance 681 between the bottom end 611 and the bottom end 615. The left lateral edge 655 of the thumb-side column 605 and the right lateral edge 656 of the thumb-side column 605 are substantially parallel to each other. Similarly, the left lateral edge 657 of the finger-side column 607 and the right lateral edge 658 of the finger-side column 607 are substantially parallel to each other.

Multiple tunnels run through the strut 600. The tunnels are sized to receive a tensioning cord that connects the strut 600 to the thumb stall and a finger stall. In one aspect, the cross-section area defined by the interior walls of the tunnel provides enough area for the tensioning cord to move relative to the tunnel wall during a tensioning. In other words, the cross-section area defined by the interior wall of the tunnels is slightly larger than the cross-sectional area of the tensioning cord. Tightening the tensioning cord can urge the thumb stall and finger stall closer together and cause the strut 600 to bow outward towards the back (e.g., dorsum) of the glove.

Tunnel 602 and tunnel 604 run through the top portion 617. Tunnel 602 and tunnel 604 run substantially parallel to the top portion 617. Tunnel 606, tunnel 608, tunnel 610, and tunnel 612 run through the thumb-side column 605 in an orientation that is parallel to each other and the top portion 617. Tunnel 614, tunnel 616, tunnel 618, and tunnel 619 run through the finger-side column 607 in an orientation that is parallel to each other and the top portion 617.

Tunnel 620, tunnel 622, and tunnel 624 run through base portion 640 in an orientation that is parallel to the top portion 617 and the other tunnels. Opening 621 and opening 623 provide access to a tensioning cord running through the tunnels 620, 622, and 624. In one aspect, a tensioning cord is tied in a knot and inserted into pocket 630. Pocket 630 may take the form of a tunnel with only one opening.

Figure 7:
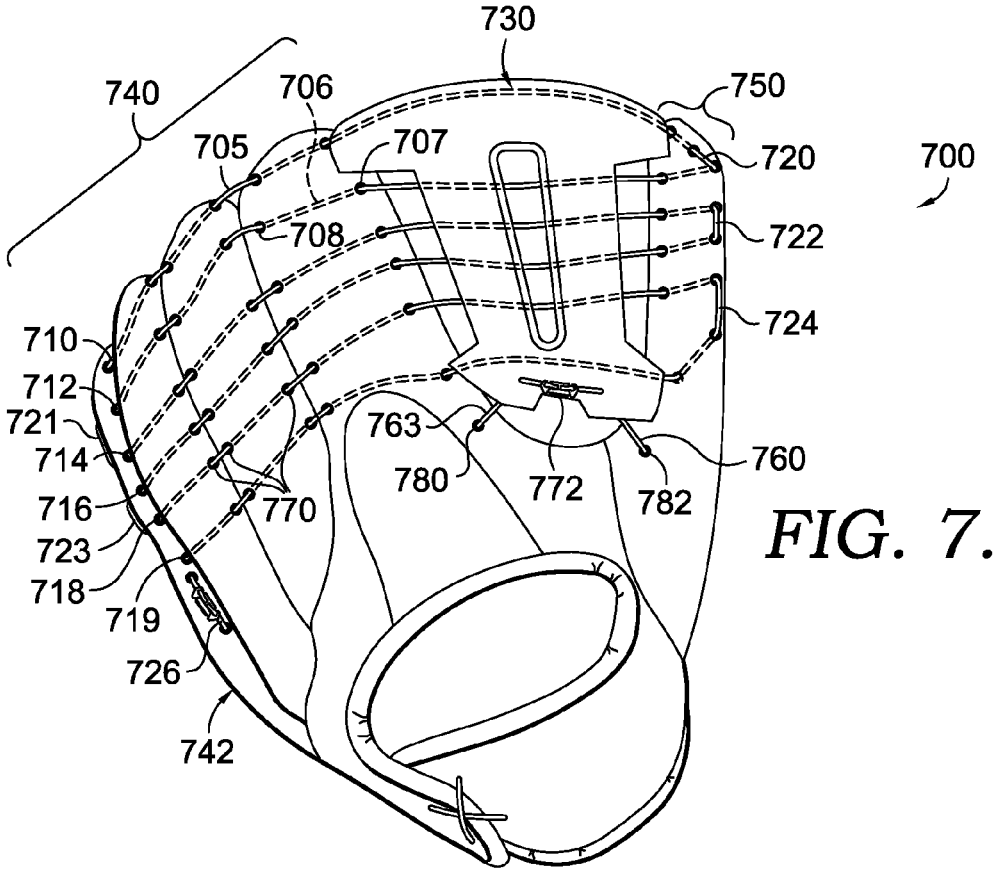
FIG. 7 is a diagram illustrating a non-convergent tensioning cord pattern, according to an aspect of the invention.

Turning now to FIG. 7, a non-convergent tensioning cord pattern is illustrated, in accordance with an aspect of the present invention. A single tensioning cord 705 traverses back and forth through the glove 700 in six different rows, in the illustrated example. However, it is contemplated that fewer or greater number of rows may be used in accordance with aspects hereof. It is also contemplated that one or more tensioning cord may be double threaded across the rows. One end of the tensioning cord 705 may be secured at a cleat (not shown) or by tying a knot (not shown) before entering the first tunnel in row 710. The tensioning cord 705 is threaded through tunnels in each finger stall of finger portion 740. In the glove 700 shown, each finger stall is separated from the adjacent finger stall by a crotch. The distance between the finger stalls may be adjusted by increasing or decreasing tension on the tensioning cord 705.

Each finger stall includes a tunnel through which the tensioning cord is thread. A tunnel may have an entrance and an exit. Tunnel 706 with entrance 707 and exit 708 is exemplary. Each tunnel is located within the interior of the finger stall between the back exterior and the front exterior of the glove 700. A tunnel may be an enclosure within the finger stall sized to receive the tensioning cord 705 one or more times. Alternatively, the tunnel is a void defined by the glove exterior and interior portions of the glove. The void is not sized or shaped to receive the tensioning cord 705 snugly and does not provide a constrained course of the cord 705. Instead, the course of the tunnel is defined primarily by the entrance and exit with only the void in-between. The openings (e.g., entrance and exits) into tunnels may be protected by reinforcements 770. The reinforcements may be a knit material that protrudes from the hole. The reinforcements help prevent the holes from stretching or tearing.

Continuing with the explanation of row 710, the tensioning cord 705 runs through tunnels in the finger stalls. The cord 705 is visible as it runs across the crotches between the finger stalls and into the next tunnel in the row. The tensioning cord 705 is thread through a top portion of the strut 730, and then loops 720 across the exterior surface of the thumb stall 750 to row 712.

In row 712, the tensioning cord 705 runs from loop 720 through a tunnel in thumb stall 750 and then through tunnels in the strut 730. The cord 705 continues in and out of tunnels in the finger stalls within the finger portion 740 to the pinky finger stall 742 side. The tensioning cord then loops 721 down along the exterior of the pinky stall 742 to row 714. Alternatively, the loop may occur on the front side of the pinky stall 742, instead of the side as shown.

In row 714, the tensioning cord 705 is thread from the pinky stall 742 back in and out of tunnels in the finger stalls within finger portion 740. The cord continues through tunnels in the strut 730 and then through a tunnel in the thumb stall 750. The cord 705 then loops 722 to row 716.

In row 716, the tensioning cord 705 is thread through tunnels in the strut 730 and then in and out of tunnels in the finger stalls within finger portion 740. The tensioning cord 705 loops 723 to row 718 on the pinky stall 742.

In row 718, the tensioning cord 705 is thread in and out of tunnels in the finger stalls within finger portion 740 and then through tunnels in the strut 730. From the strut 730 the tensioning cord 705 runs through a tunnel in the thumb stall 750 and loops 724 to the beginning of row 719.

In row 719, the tensioning cord 705 is thread through a tunnel through the base of the strut 730 and then in and out of tunnels in the finger stalls within finger portion 740. The end of tensioning cord 705 may loop down the interior facing or exterior facing portion of the finger where it is secured by a knot (not shown) or attached to a cleat 726 located on glove 700.

A similar pattern may be used in a first baseman's mitt or a catcher's mitt. In one aspect, a single tunnel is provided through the finger portion instead of separate tunnels in each finger stall. First basemen's and catchers' mitts may not have crotches between finger stalls and may not need separate tunnels through each finger stall.

Thus, a single tensioning cord runs back and forth from the pinky stall 742 through the finger portion 740, through the strut 730, and through the thumb stall 750 six times without intersecting or converging. This pattern allows the energy from receiving a baseball to be dissipated across the glove 700. The pattern also allows the glove 700 to be adjusted using a single tensioning cord that urges the finger portion and the thumb stall together.

The glove 700 may include additional cords or laces, but in one aspect no other laces or tensioning cords run between the finger stall portion 740, the strut 730, and the thumb stall 750. Other cords may run between the strut and the palm portion. For example, cord 760 may provide an additional connection point between the strut 730 and the glove body. In FIG. 7, tensioning cord 760 is thread through the strut 730 and tunnel 782. Tunnel 782 may run through the body of the glove 700 from the back exterior to the front exterior. Tensioning cord 763 is thread through the strut 730 and tunnel 780. Tunnel 780 may run through the body of the glove 700 from the back exterior to the front exterior. Tensioning cord 760 and tensioning cord 763 may be secured on cleat 772. Though not shown, additional laces, yam, threads, or cords may be used in glove construction, for example, to form a finger stall by sewing a top portion to a bottom portion or to form the palm section by connecting the back-facing exterior portion to the front-facing exterior portion.

Figure 8:
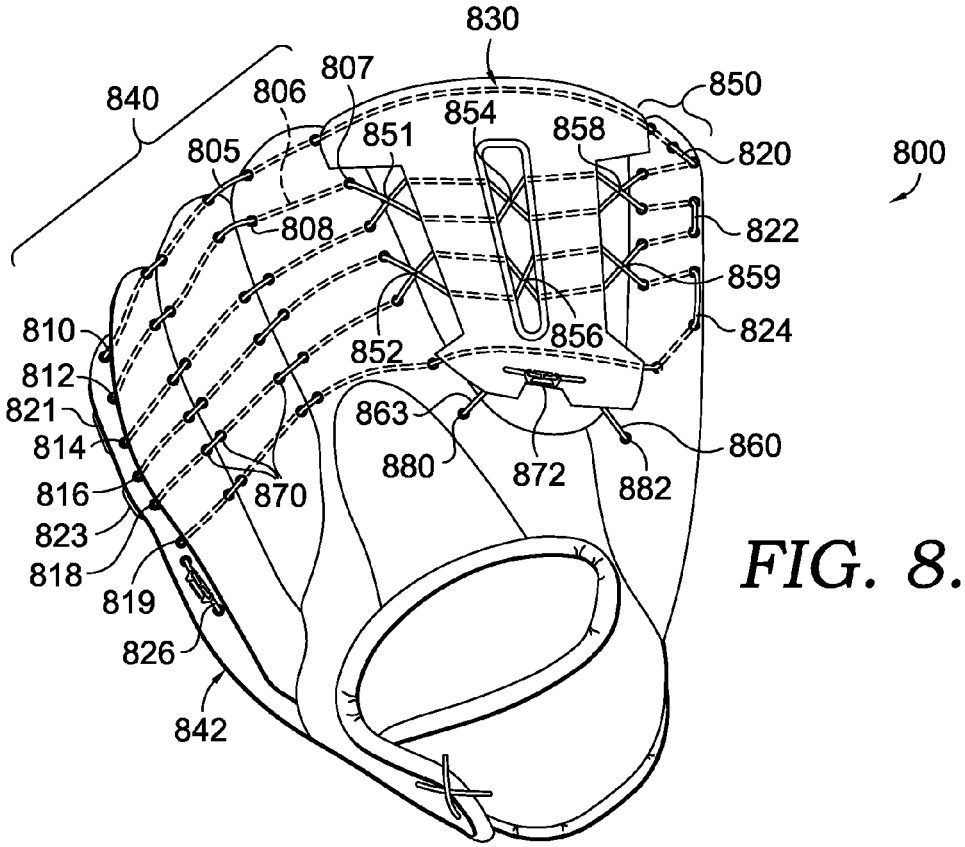
FIG. 8 is a diagram illustrating a convergent tensioning cord pattern, according to an aspect of the invention.

Turning now to FIG. 8, a convergent tensioning cord pattern is illustrated, in accordance with an aspect of the present invention. A single tensioning cord 805 traverses back and forth through the glove 800 in six different rows. However, as discussed with respect to FIG. 7, it is contemplated that greater or fewer rows may be used in accordance with aspects hereof. It is also contemplated that one or more tensioning cord may be double threaded across the rows. Starting at the pinky stall 842, the tensioning cord 805 is threaded through tunnels in each finger stall of finger portion 840 in row 810. In the glove 800 shown, each finger stall is separated from the adjacent finger stall by a crotch. The distance between the finger stalls may be adjusted by increasing or decreasing tension on the tensioning cord 805.

Each finger stall includes a tunnel through which the tensioning cord is thread. A tunnel may have an entrance and an exit. Tunnel 806 with entrance 807 and exit 808 is exemplary. Each tunnel is located within the interior of the finger stall between the back exterior and the front exterior of the glove 800. A tunnel may be an enclosure within the finger stall sized to receive the tensioning cord 805. Alternatively, the tunnel is a void defined by the glove exterior and interior portions of the glove. The void is not sized or shaped to receive the tensioning cord 805 snugly and does not provide a constrained course of the cord 805. Instead, the course of the tunnel is defined primarily by the entrance and exit with only the void in-between. The openings (e.g., entrance and exits) into tunnels may be protected by reinforcements 870. The reinforcements may be a knit material that protrudes from the hole. The reinforcements help prevent the holes from stretching or tearing.

Continuing with the explanation of row 810, the tensioning cord 805 runs through tunnels in the finger stalls. The cord 805 is visible as it runs across the crotches between the finger stalls and into the next tunnel in the row. The tensioning cord 805 is thread through a top portion of the strut 830, and then loops 820 across the exterior surface of the thumb stall 850 to row 812.

From loop 820 the tensioning cord 805 runs through a tunnel in thumb stall 850 to convergence 858 where it crosses under itself to a tunnel through the strut 830 in row 814. The cord 805 exits the row 814 tunnel and crosses itself at convergence 854 to enter a row 812 tunnel through the finger-side strut of strut 830. The cord 805 crosses itself at convergence 851 and enters a row 814 tunnel in the index finger stall. From the index finger stall, the tensioning cord 805 runs in and out of row 814 tunnels in the finger stalls and then loops 821 up to row 812.

In row 812, the tensioning cord 805 is thread in and out of tunnels in the finger stalls within finger portion 840. The tensioning cord 805 crosses under or over itself at convergence 851, 854, and 858 and runs through a row 814 tunnel in the thumb stall 850. The tensioning cord 805 loops 822 on the thumb stall 850 to row 816. The tensioning cord 805 crosses under or over itself at convergence 859, 856, and 852 and is thread in and out of row 818 tunnels in the finger stalls within finger portion 840. The tensioning cord 805 loops 823 to row 816, which is thread in and out of row 816 tunnels in the finger stalls. The tensioning cord 805 crossing under or over itself at convergence 852, 856, and 859 and continues through a tunnel in thumb stall 850 to loop 824. The tensioning cord 805 loops 824 down to row 819 on thumb stall 850. The tensioning cord 805 runs through a tunnel in the base of the strut 830 and then in and out of row 819 tunnels in the finger stalls within finger portion 840 to the pinky stall 842. The tensioning cord 805 may loop down the interior or exterior facing portion of the finger where it is secured by a knot or attached to a cleat 826 located on the side or back of glove 800.

A similar pattern may be used in a first baseman's mitt or a catcher's mitt. In one aspect, a single tunnel is provided through the finger portion instead of separate tunnels in each finger stall. First basemen's and catchers' mitts may not have crotches between finger stalls and may not need separate tunnels through each finger stall.

Thus, a single tensioning cord runs back and forth from the pinky stall 842 through the finger portion 840, through the strut 830, and through the thumb stall 850 six times while converging several times at the strut 830. This pattern allows the energy from receiving a baseball to be dissipated across the glove 800. The pattern also allows the glove 800 to be adjusted using a single tensioning cord that urges the finger portion and the thumb stall together.

The glove 800 may include additional cords or laces, but in one aspect no other laces or tensioning cords run between the finger stall portion 840, the strut 830, and the thumb stall 850. Other cords may run between the strut and the palm portion. For example, cord 860 may provide an additional connection point between the strut 830 and the glove body. In FIG. 8, tensioning cord 860 is thread through the strut 830 and tunnel 882. Tunnel 882 may run through the body of the glove 800 from the back exterior to the front exterior. Tensioning cord 863 is thread through the strut 830 and tunnel 880. Tunnel 880 may run through the body of the glove 800 from the back exterior to the front exterior. Tensioning cord 860 and tensioning cord 863 may be secured on cleat 872. Though not shown, additional laces, yarn, threads, or cords may be used in glove construction, for example, to form a finger stall by sewing a top portion to a bottom portion or to form the palm section by connecting the back-facing exterior portion to the front-facing exterior portion.

Figure 9:
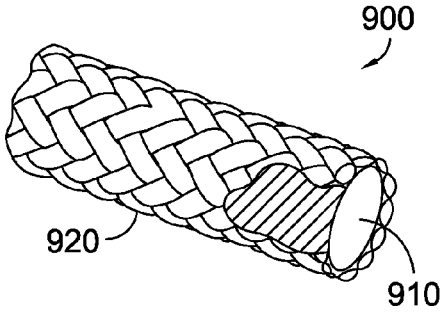
FIG. 9 is a diagram illustrating a tensioning cord, according to an aspect of the invention.

Turning now to FIG. 9, a cutaway view of a tensioning cord 900 is shown according to an aspect. The tensioning cord 900 is an elongated object that can include an interior tension cable 910 and a sheath 920. The interior tension cable 910 may be a stranded steel cable, nylon, aramid (e.g., KEVLAR available from DuPont), or other suitable material. In one aspect, the interior cable 910 has a modulus of elasticity of at least 20,000 psi. The interior cable 910 can be constructed from materials having different properties. The modulus of elasticity can be increased or decreased by adding or subtracting elastic materials from the interior cable 910. In one aspect, the interior cable 910 has a diameter between 1.5 mm and 8 mm, for example 2 millimeters, 2.5 mm, 4 mm, or 6 mm. The sheath 920 may be a woven or knit covering formed from a polymer, such as nylon, or similar. The sheath 920 material can be selected to have a coefficient friction between 0.15-0.25. The sheath 920, the interior tension cable 910, or both could include a coating of silicone, polyurethane, or other material with similar properties to alter a coefficient of friction to adjust the frictional interaction of the tensioning cable and the materials of the glove.

Though not shown, an aglet can be added to one or both ends of the tensioning cord 900 to ease threading the tensioning cord through tunnels in the glove and/or to provide a finished end that resists fraying or unraveling. In one aspect, the interior cable 910 is not constructed from real leather or synthetic leather. Instead, in an aspect, the interior cable 910 is a monofilament or multi-filament synthetic material encased in a woven or knit sheath that is also formed from a synthetic material.

Figure 10:
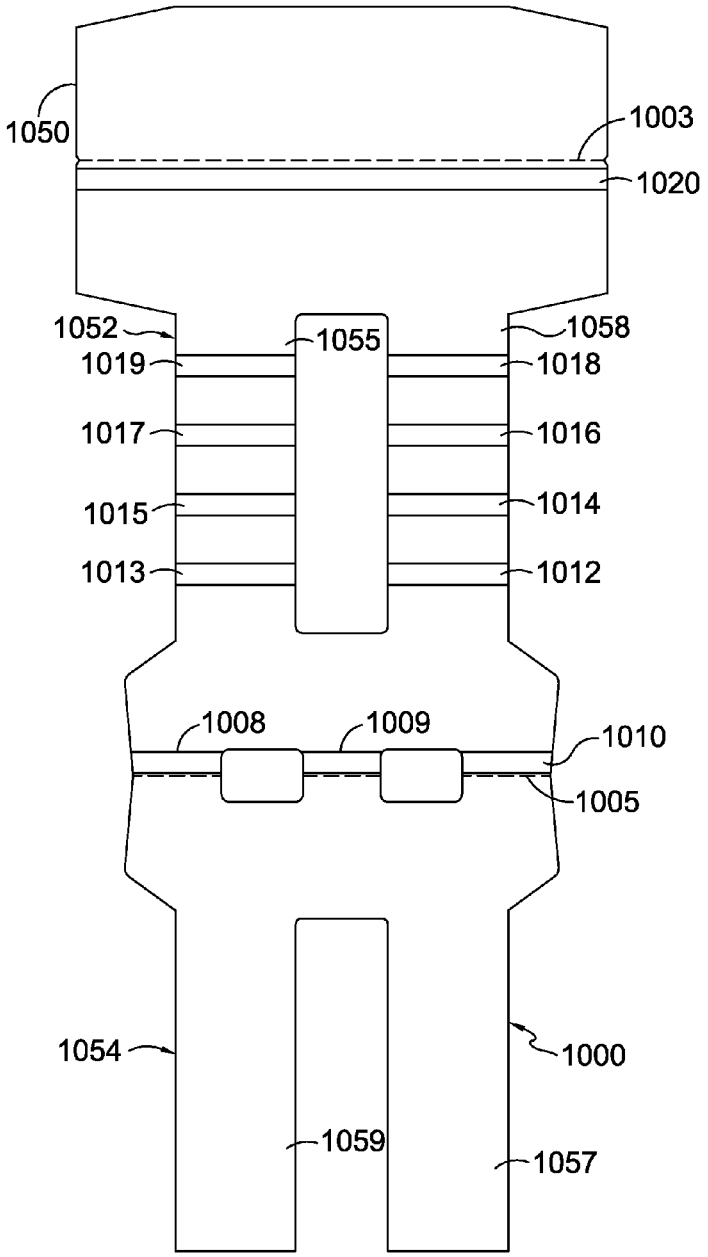
FIGS. 10-12 are diagrams illustrating the construction or a strut, according to an aspect of the invention.
Figure 12:
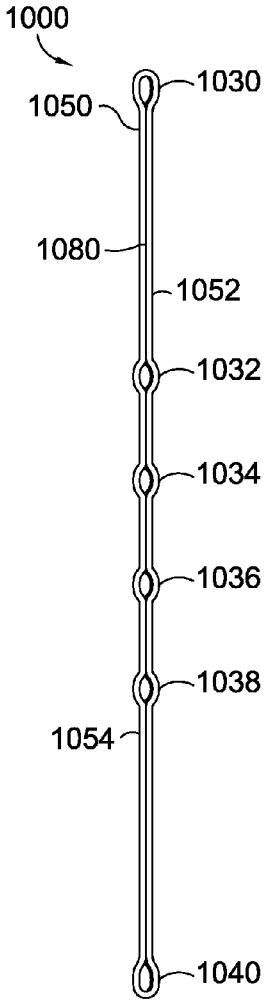
Figure 11:
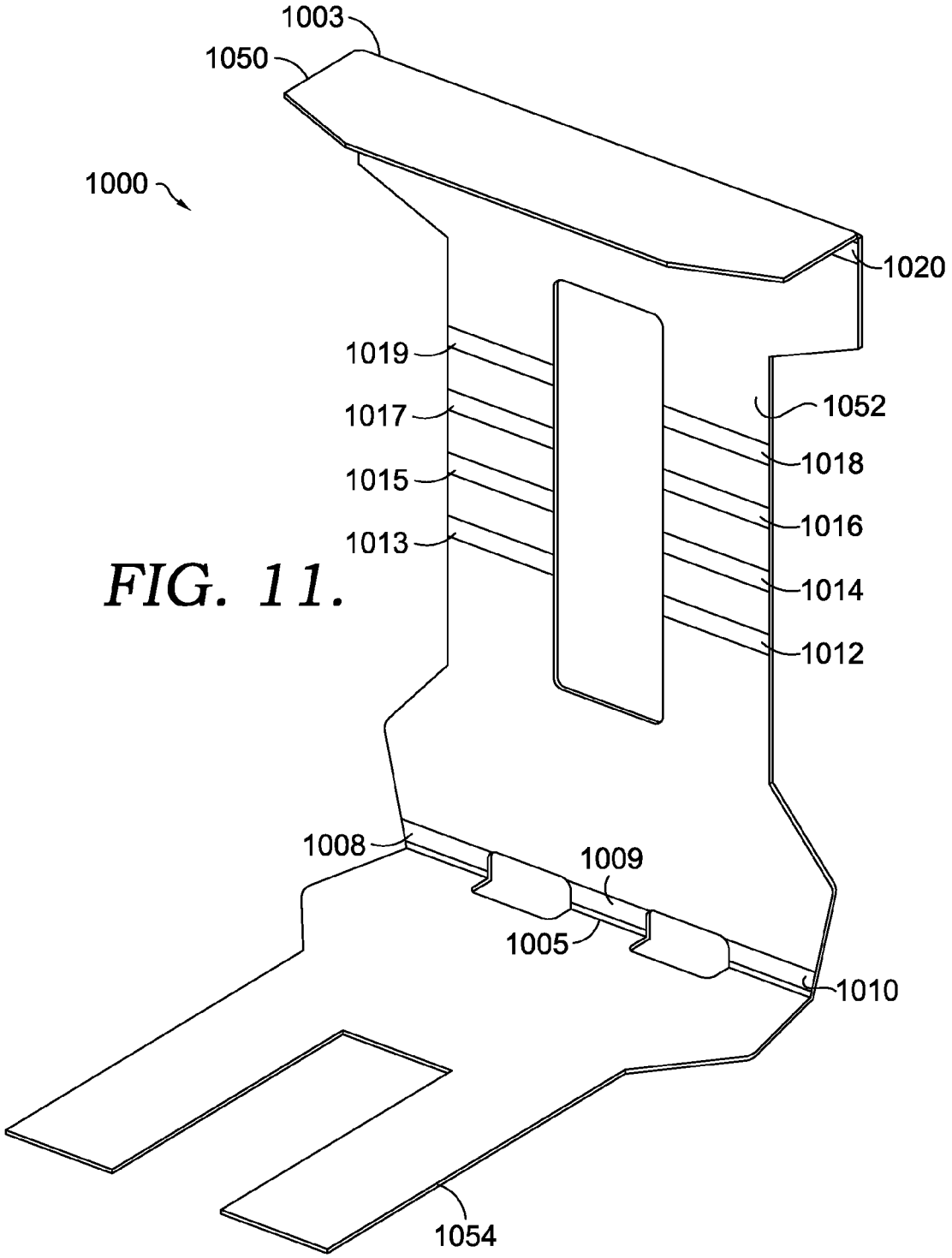

Turning now to FIGS. 10-12, the construction of a strut is illustrated, according to an aspect of the invention. The strut is constructed by folding strut template 1000 together and welding (or otherwise coupling) the three portions together. In one aspect, radio frequency welding is used to form the strut. In one aspect, an adhesive is used to form the strut. Thus, the strut template 1000 can comprise a weldable material, such as synthetic leather, certain plastics, and such. Tunnels in the strut may be formed by strips of scrim attached to the surface of the strut template in different places. The scrim may be formed material that allows the tensioning cord to move through the tunnels. Scrims in the strut template 1000 include scrim 1008, scrim 1009, scrim 1010, scrim 1012, scrim 1013, scrim 1014, scrim 1015, scrim 1016, scrim 1017, scrim 1018, scrim 1019, and scrim 1020. The strut template 1000 may be folded at fault lines 1005 and 1003 to bring the upper template portion 1050 and the lower template portion 1054 to overlap with the main template portion 1052. When folded, column 1059 may substantially overlap column 1052. When folded, column 1057 may substantially overlap column 1058.

It is contemplated that by folding at the fault lines 1005 and 1003, which results in a joint 1080 (discussed hereafter with respect to FIG. 12) that is not located at a top edge or a bottom edge of the formed strut, an increased resistance to tearing or deforming from one or more tensioning cables extending through tunnels is achieved, For example, instead of merely bonding two-similarly shaped portions together to form a strut having tunnels extending there through and a joint at an upper and/or lower edge, the strut template 1000 allows for a joint to be positioned in a desired less-critical location of the resulting strut. It is this manipulation of the joint location provided by the strut template 1000 that provides additional strength and resistance to deformation, in an exemplary aspect.

Turning now to FIG. 11, folding of the strut template 1000 in preparation for welding is shown, in accordance with an aspect of the invention. As can be seen, the upper template portion 1050 is folded down onto the main template portion 1052. The upper template portion 1050 covers scrim 1020. The lower template portion 1054 is folded over the main template portion 1052 covering scrims 1008, 1009, 1010, 1012, 1013, 1014, 1015, 1016, 1017, 1018, and 1019. Once folded, the two sides are welded together. Again, the scrims prevent the two sides from being welded together wherever the scrims are located and form tunnels.

Turning now to FIG. 12, a side view of the welded strut template 1000 is shown, in accordance with an aspect of the invention. The welded strut template 1000 includes tunnel 1030, tunnel 1032, tunnel 1034, tunnel 1036, tunnel 1038, and tunnel 1040. As can be seen, the upper template portion 1050 and the lower template portion 1054 have been welded to main template portion 1052, except where the scrims allow tunnels to be formed. Joint 1080 is where the top of the upper template portion 1050 and the bottom of the lower template portion 1054 come together when folded. As can be seen in the side view, the main template portions may include semi-circular features where the scrims are located. The semi-circular features can provide additional interior volume within the tunnels to allow one or more tensioning cords to be thread through the tunnel.

Alternatively, the strut template 1000 can be substantially planar without semicircular features and the semicircular features may be formed by including indentations in the face of the welding mechanism that presses the different portions of the strut template 1000 together. The indentations can prevent pressure from being applied at the tunnel portions during the welding process. Whether this strut template 1000 is substantially planar or is initially formed with the semi-circular features, indentations can be included on the face of the welding apparatus to help form the tunnels.

Figure 13:
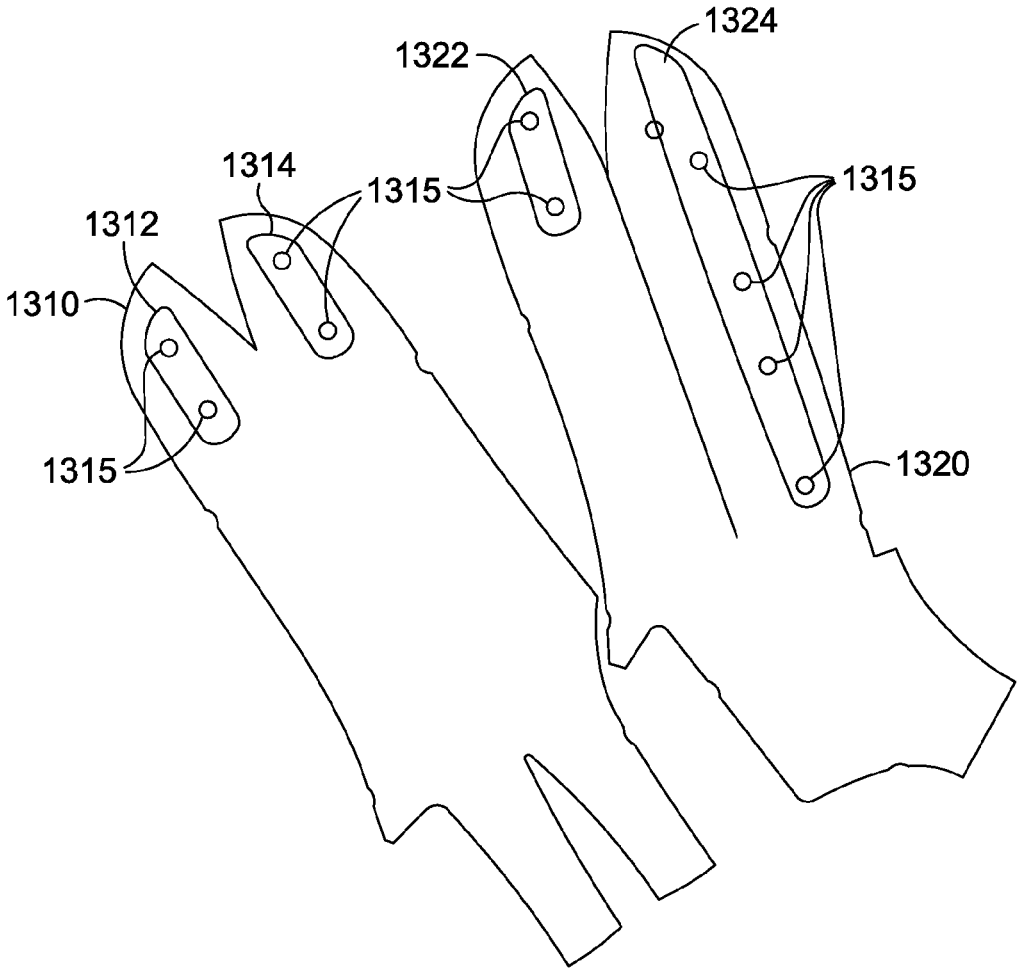
FIGS. 13-15 are diagrams illustrating reinforcements for tensioning-cord holes, according to an aspect of the invention.

Turning now to FIG. 13, tunnel reinforcements are illustrated in accordance with an aspect of the invention. The reinforcements 1312 and 1314 are located on the exterior covering 1310 that forms part of the middle finger stall. The exterior covering 1310 may form the back side of the thumb stall. The exterior covering 1310 is shown in FIG. 13 prior to construction of the glove. As such, the exterior covering 1310 is largely planar. During construction, the exterior covering 1310 may be joined with other pieces to form a finger stall and eventually the glove. The exterior covering 1310 may be leather, synthetic leather, a textile, or similar. When fully constructed and incorporated into a glove, the reinforcements 1312 and 1314 can be oriented towards the side of the finger stall at least partially between an adjacent finger stall. The reinforcements 1312 and 1314 include holes 1315 through which a tensioning cord may be threaded. The reinforcements 1312 and 1314 may be fiberglass, plastic, metal, or a textile such as a knit or woven material. The reinforcement can prevent deformation, such as tearing and stretching, of the material used in the exterior covering 1310.

The exterior covering 1320 forms part of an index finger stall. The exterior covering 1320 includes reinforcement 1322 and reinforcement 1324. Reinforcement 1324 includes holes 1315 and is longer than the other reinforcements. When constructed, the index finger is adjacent to the strut between the index finger stall and the thumb stall and may receive more direct force from the ball hitting the strut, making the additional reinforcements beneficial.

Figure 14:
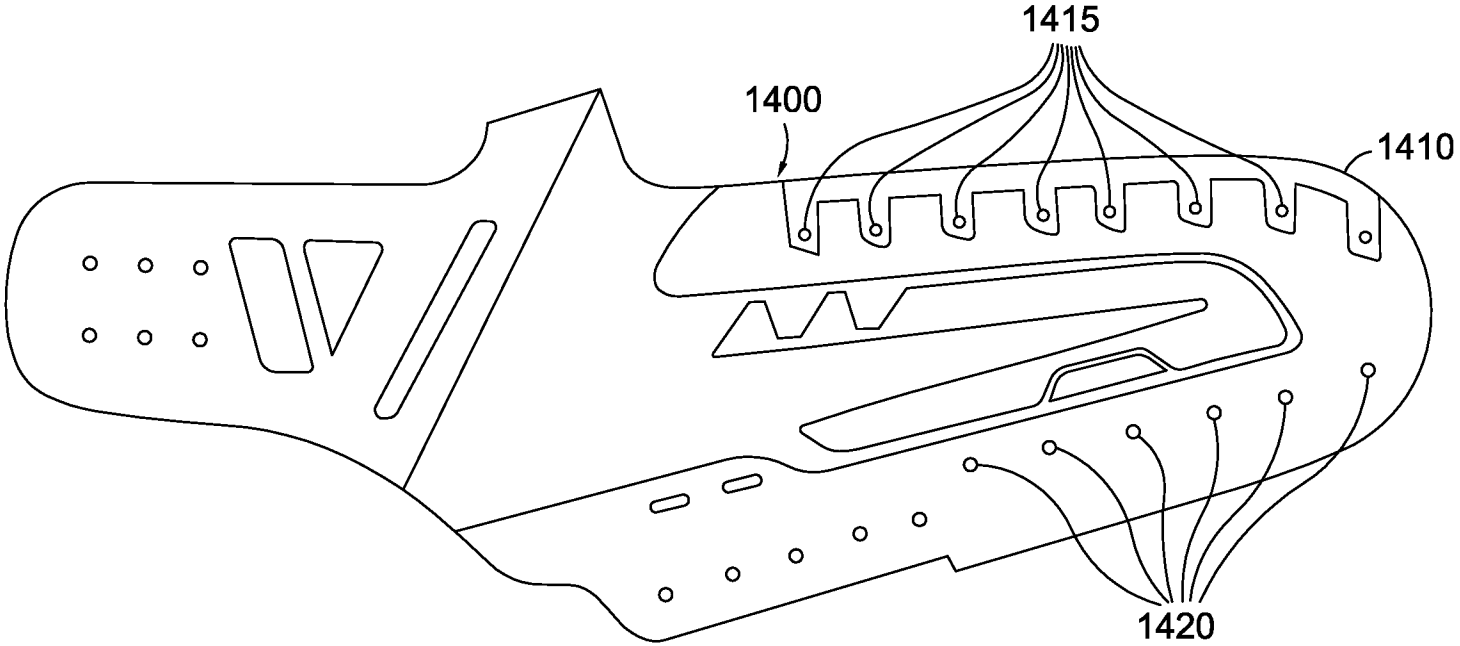
Figure 15:
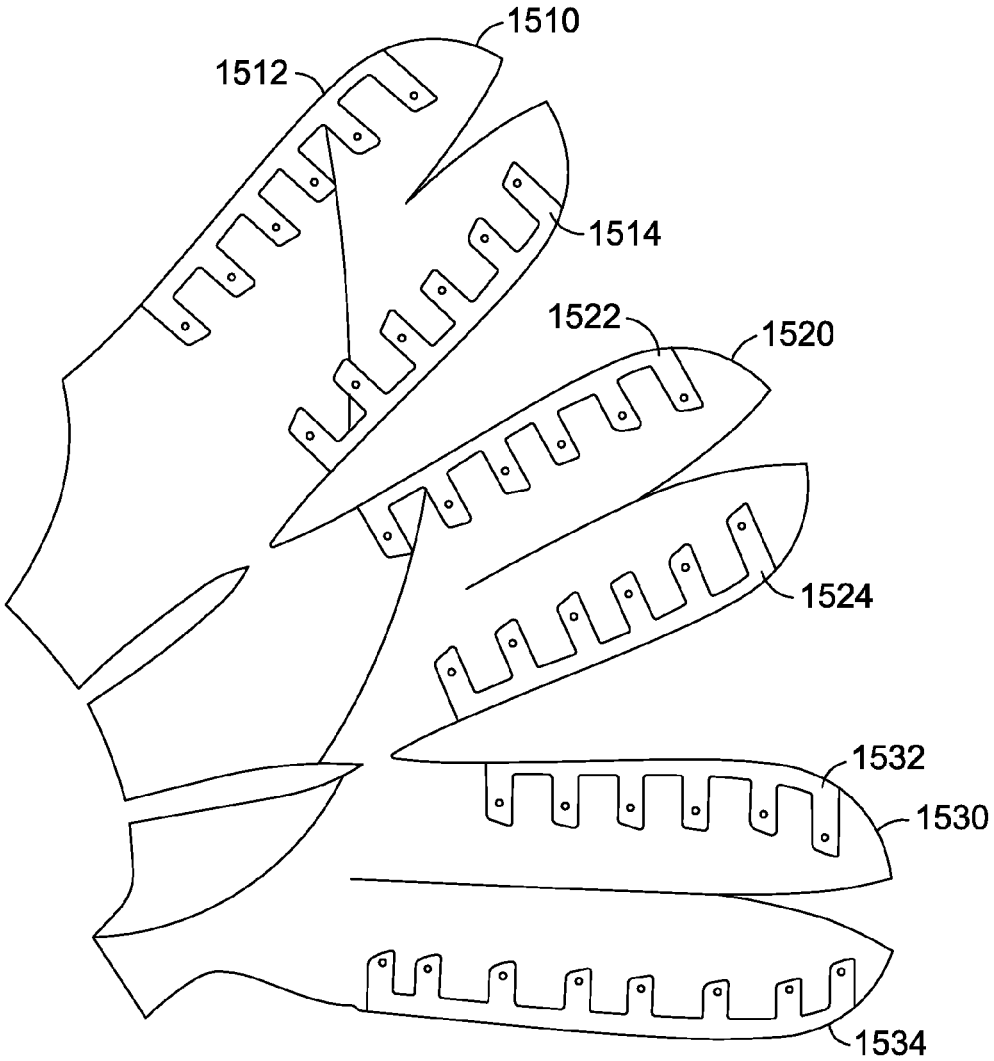

Turning now to FIGS. 14 and 15, alternative reinforcements are illustrated in accordance with an aspect of the invention. In one aspect, the reinforcements are constructed from a non-woven material manufactured using a combination of polyester materials and processes to create the required properties suitable to reinforce the tunnel entrances and exits. The reinforcements of FIGS. 14 and 15 differ from the reinforcements of FIG. 13 in size and shape. FIG. 14 illustrates a portion of the exterior cover 1400 that forms a back-facing part of a thumb stall. The exterior cover 1400 includes a reinforcement 1410 along the strut-side of the thumb stall. The strut side is adjacent to the strut of a fully formed glove. The reinforcement 1410 includes several holes 1415 through which a tensioning cord may be thread. Notice that the exterior cover 1400 also includes holes 1420 without a reinforcement. This illustrates that within a particular glove some holes may be reinforced while others are not. The choice whether or not to reinforce a particular hole may be made based on the expected forces applied to the hole by the tensioning cord and the ability of the material surrounding the hole to resist stretching and tearing.

Turning now to FIG. 15, reinforcements within finger stalls are illustrated, in accordance with an aspect of the present invention. In one aspect, the reinforcements are constructed from a non-woven material manufactured using a combination of polyester materials and processes to create the required properties suitable to reinforce the tunnel entrances and exits. FIG. 15 includes exterior cover 1510, exterior cover 1520 and exterior cover 1530. Each of these covers may form part of a finger stall. Specifically, each of these covers may form the back-facing exterior of a finger stall. The exterior cover 1510 includes reinforcement 1512 and reinforcement 1514. The exterior cover 1520 includes reinforcement 1522 and reinforcement 1524. The exterior cover 1530 includes reinforcement 1532 and reinforcement 1534. Each of the reinforcements includes holes through which tensioning cord may be threaded. In FIG. 15 each reinforcement, with the exception of reinforcement 1534, includes six holes. The six holes may correspond to the entrance or exit of tunnels arranged in six different rows, as illustrated previously with reference to FIGS. 7 and 8. Reinforcement 1534 may include additional holes to receive additional cords associated with the strut.

From the foregoing, it will be seen that this invention is one well adapted to attain all the ends and objects hereinabove set forth together with other advantages which are inherent to the structure.

It will be understood that certain features and subcombinations are of utility and may be employed without reference to other features and subcombinations. This is contemplated by and is within the scope of the claims.

Since many possible structures may be made of the invention without departing from the scope thereof, it is to be understood that all matter herein set forth or shown in the accompanying drawings is to be interpreted as illustrative and not in a limiting sense.

What is claimed is:

1. A fielding glove comprising:

a finger stall portion having a base and a terminal end opposite the base, the finger stall portion comprising one or more finger stalls, an exterior edge of the finger stall portion forming a first lateral edge of the glove;

a thumb stall separated from the finger stall portion by a crotch, an exterior edge of the thumb stall forming a second lateral edge of the glove, the thumb stall having a base and a terminal end opposite the base;

a palm portion connecting to the base of the finger stall portion and to the base of the thumb stall;

a strut installed in the crotch formed between an interior edge of the thumb stall and an interior edge of the finger stall portion;

a tensioning cord interconnecting the finger stall portion, the thumb stall, and the strut, the tensioning cord permitting a wearer to adjust a tension with which the tensioning cord interconnects the finger stall portion, the thumb stall, and the strut; and at least one cleat positioned on an exterior of the thumb stall, the at least one cleat comprising a guide slot through which the tensioning cord is slidably threaded, the at least one cleat including a cleat horn onto which the tensioning cord is releasably coupled.

2. The fielding glove of claim 1, wherein the tensioning cord releasably attaches to the at least one cleat at a first point on the tensioning cord under a first tension and wherein the tensioning cord releasasbly attaches to the at least one cleat at a second point on the tensioning cord when the tension is adjusted and a second tension is applied.

3. The fielding glove of claim 2, wherein an exterior facing side of the palm portion comprises perforations.

4. The fielding glove of claim 3, wherein the perforations extend entirely through a synthetic leather surface used to form an exterior of the palm portion.

5. The fielding glove of claim 3, wherein an amount of the perforations per unit area on the exterior facing side of palm portion vary.

6. The fielding glove of claim 1, wherein the tensioning cord is comprised of a metallic material.

7. The fielding glove of claim 1, wherein the tensioning cord has a diameter between 1.5 and 2.5 millimeters.

8. The fielding glove of claim 1, wherein the strut comprises a thumb-side column having a top and a bottom and a finger-side column having a top and a bottom, a top beam extending between the top of the thumb-side column and the top of the finger-side column, and a base portion extending between the bottom of the thumb-side column and the bottom of the finger-side column, wherein a first distance between the top of the thumb-side column and the top of the finger-side column is greater than a second distance between the bottom of the thumb-side column and the bottom of the finger-side column.

9. The fielding glove of claim 8, wherein the thumb-side column and the finger-side column each comprise multiple tunnels for enclosing the tensioning cord, the multiple tunnels running through the thumb-side column and the finger-side column with an orientation that is perpendicular to a direction of the finger stall portion and the thumb stall extending from the base end towards the terminal end, respectively.

10. A fielding glove comprising:

a finger stall portion having a base and a terminal end opposite the base, the finger stall portion comprising one or more finger stalls, an exterior edge of the finger stall portion forming a first lateral edge of the glove;

a thumb stall separated from the finger stall portion by a crotch, an exterior edge of the thumb stall forming a second lateral edge of the glove, the thumb stall having a base and a terminal end opposite the base;

a palm portion connecting to the base of the finger stall portion and to the base of the thumb stall;

a strut installed in the crotch formed between an interior edge of the thumb stall and an interior edge the finger stall portion; and wherein the finger stall portion and the thumb stall each comprise multiple tunnels for enclosing at least one tensioning cord, the multiple tunnels running through the thumb stall and the finger stall portion with an orientation that is perpendicular to a direction defined by the finger stall portion and the thumb stall extending from the base end towards the terminal end, wherein each of the multiple tunnels comprises a first aperture, a second aperture and an intervening tunnel portion, wherein each of the thumb stall and the finger stall portion comprises tunnel reinforcements surrounding the first and second apertures of the multiple tunnels, and wherein the tunnel reinforcements are positioned on an exterior surface of the thumb stall and finger stall portion.

11. The fielding glove of claim 10, wherein the multiple tunnels comprise at least four tunnels.

12. The fielding glove of claim 10, further comprising the tensioning cord interconnecting the finger stall portion, the thumb stall, and the strut, the tensioning cord permitting a wearer to adjust a tension with which the tensioning cord interconnects the finger stall portion, the thumb stall, and the tensioning cord.

13. The fielding glove of claim 12, wherein the tensioning cord is comprised of a synthetic material and has a diameter between 1.5 and 2.5 millimeters.

14. The fielding glove of claim 13, wherein the palm portion further comprises a plurality of perforations having a diameter that is between 0.1 and 5 mm.

15. A fielding glove comprising:

an exterior-facing palm portion comprising at least one perforated surface, the exterior-facing palm portion adapted for contacting a fielded ball when the fielding glove is used and worn, the exterior-facing palm portion having four finger stalls and one thumb stall;

a finger stall portion having a base and a terminal end opposite the base, the finger stall portion comprising one or more finger stalls, an exterior edge of the finger stall portion forming a first lateral edge of the glove;

a thumb stall separated from the finger stall portion by a crotch, an exterior edge of the thumb stall forming a second lateral edge of the glove, the thumb stall having a base and a terminal end opposite the base;

a palm portion connecting to the base of the finger stall portion and to the base of the thumb stall;

a strut installed in the crotch formed between an interior edge of the thumb stall and an interior edge of the finger stall portion;

a plurality of tunnels interconnecting the finger stall portion, the thumb stall, and the strut, wherein each of the plurality of tunnels is spaced in a parallel relationship to one another, wherein each of the plurality of tunnels comprises a first aperture, a second aperture, and an intervening tunnel portion;

a first tensioning cord threaded through the plurality of tunnels interconnecting the finger stall portion, the thumb stall, and the strut, the tensioning cord permitting a wearer to adjust a tension with which the tensioning cord interconnects the finger stall portion, the thumb stall, and the strut a second tensioning cord double threaded with the single tensioning cord and interconnecting the finger stall portion, the thumb stall, and the strut, the tensioning cord permitting the wearer to adjust a tension with which the tensioning cord interconnects the finger portion, the thumb stall, and the strut; and a plurality of reinforcement portions surrounding the first aperture and second aperture of the plurality of tunnels, wherein the reinforcement portions are positioned on an exterior surface of the finger stall portion and the thumb stall.

16. The fielding glove of claim 15, wherein the at least one cushioning layer is a lightweight foam layer.

* * * * *